US011667023B2

(12) United States Patent
Vandenberg

(10) Patent No.: US 11,667,023 B2
(45) **Date of Patent: *Jun. 6, 2023**

(54) HYBRID CORDLESS CAP TOOL

(71) Applicant: National Nail Corp., Grand Rapids, MI (US)

(72) Inventor: Roger A. Vandenberg, Hudsonville, MI (US)

(73) Assignee: National Nail Corp., Grand Rapids, MI (US)

( * ) Notice: Subject to any disclaimer, the term of this patent is extended or adjusted under 35 U.S.C. 154(b) by 278 days.

This patent is subject to a terminal disclaimer.

(21) Appl. No.: 17/182,380

(22) Filed: Feb. 23, 2021

(65) Prior Publication Data

US 2021/0178562 A1 Jun. 17, 2021

Related U.S. Application Data

(63) Continuation of application No. 16/430,619, filed on Jun. 4, 2019, now Pat. No. 10,960,525.

(60) Provisional application No. 62/685,502, filed on Jun. 15, 2018.

(51) Int. Cl.

| | |
|---|---|
| ***B25C 1/00*** | (2006.01) |
| ***B25C 1/06*** | (2006.01) |
| ***B25C 7/00*** | (2006.01) |
| *B25C 5/15* | (2006.01) |
| *B25C 5/16* | (2006.01) |

(52) U.S. Cl.

CPC ..... *B25C 1/06* (2013.01); *B25C 1/003* (2013.01); *B25C 1/008* (2013.01); *B25C 7/00* (2013.01); *B25C 5/15* (2013.01); *B25C 5/1693* (2013.01)

(58) Field of Classification Search

CPC ..... B25C 1/06; B25C 1/003; B25C 1/008; B25C 7/00; B25C 5/1693

USPC ..... 227/8, 64–76; 173/31, 37, 90, 197, 213, 173/171

See application file for complete search history.

(56) References Cited

U.S. PATENT DOCUMENTS

| | | | |
|---|---|---|---|
| 2,925,602 | A | 2/1960 | Kopf et al. |
| 3,060,440 | A | 10/1962 | Pfaff et al. |
| 3,602,419 | A | 8/1971 | Doberne et al. |
| 3,638,892 | A | 2/1972 | Boye et al. |
| 3,734,377 | A | 5/1973 | Munn |

(Continued)

FOREIGN PATENT DOCUMENTS

| | | | |
|---|---|---|---|
| AU | 2007202763 | A1 | 1/2008 |
| AU | 2013206456 | A1 | 1/2014 |

(Continued)

*Primary Examiner* — Robert F Long

(74) *Attorney, Agent, or Firm* — Warner Norcross + Judd LLP

(57) ABSTRACT

A construction tool and method for use for administering a fastener and an associated cap to secure fabrics, paper, sheets, and/or panels to a substrate is provided. The tool can be a hybrid tool that utilizes a) energy stored in a spring, the energy harvested upon engagement of the tool with a surface, to move a cap and/or a fastener to an advancement station, and b) energy stored in a power source, such as a battery, to advance the fastener through the cap and apply the fastener/cap combination to a substrate. The hybrid tool can utilize both energy harvested from mechanical motion and energy stored in an onboard power source to function. A related method of using the tool is provided.

20 Claims, 10 Drawing Sheets

(56) References Cited

U.S. PATENT DOCUMENTS

| | | | | |
|---|---|---|---|---|
| 3,860,290 | A * | 1/1975 | Mappin | E21C 27/28 299/32 |
| 4,088,289 | A * | 5/1978 | Wood | E21B 7/023 173/28 |
| 4,809,568 | A | 3/1989 | DeCaro | |
| 5,199,506 | A | 4/1993 | Dewey et al. | |
| 5,407,313 | A | 4/1995 | Bruins et al. | |
| 5,484,094 | A | 1/1996 | Gupta | |
| 5,529,451 | A | 6/1996 | Bruins et al. | |
| 5,772,381 | A | 6/1998 | Olvera et al. | |
| 5,943,926 | A | 8/1999 | Habermehl | |
| 5,947,362 | A | 9/1999 | Dmli | |
| 5,997,455 | A * | 12/1999 | Matsuoka | B23B 31/263 409/233 |
| 6,145,723 | A | 11/2000 | Gupta | |
| 6,145,725 | A | 11/2000 | Omli | |
| 6,164,170 | A | 12/2000 | Habermehl et al. | |
| 6,213,371 | B1 | 4/2001 | Cabrera | |
| 6,237,827 | B1 * | 5/2001 | Reckelhoff | B25C 5/1603 227/155 |
| 6,478,209 | B1 | 11/2002 | Bruins et al. | |
| 6,598,775 | B1 | 7/2003 | Chen | |
| 6,779,700 | B2 * | 8/2004 | Bruins | B25C 1/006 227/18 |
| 6,783,048 | B2 | 8/2004 | Powell | |
| 6,908,022 | B2 * | 6/2005 | Schmitz | B25C 5/1693 227/18 |
| 6,966,389 | B1 | 11/2005 | Riggs | |
| 6,968,945 | B2 | 11/2005 | Bruins et al. | |
| 7,093,338 | B2 | 8/2006 | Powers et al. | |
| 7,207,095 | B2 | 4/2007 | Bruins et al. | |
| 7,232,050 | B2 | 6/2007 | Omli | |
| 7,344,058 | B2 | 3/2008 | Bruins et al. | |
| 7,481,346 | B2 | 1/2009 | Vanden Berg et al. | |
| 7,506,789 | B2 | 3/2009 | Shor | |
| 7,530,483 | B2 | 5/2009 | Bruins et al. | |
| 7,628,305 | B2 | 12/2009 | Vanden Berg et al. | |
| 7,836,970 | B2 | 11/2010 | Bruins et al. | |
| 8,382,414 | B2 | 2/2013 | Vandenberg | |
| 8,413,740 | B2 | 4/2013 | Rodenhouse | |
| D704,018 | S | 5/2014 | Vandenberg | |
| 8,955,210 | B2 | 2/2015 | Vandenberg | |
| 9,120,214 | B2 | 9/2015 | Vandenberg | |
| 9,144,896 | B2 | 9/2015 | Vandenberg | |
| D742,730 | S | 11/2015 | Vandenberg | |
| 9,222,269 | B2 | 12/2015 | Bruins | |
| 9,258,980 | B2 | 2/2016 | Busch et al. | |
| 9,802,300 | B2 | 10/2017 | Vandenberg | |
| 9,932,744 | B2 | 4/2018 | Vandenberg | |
| 10,052,747 | B2 * | 8/2018 | Aoki | B25D 11/005 |
| D842,086 | S | 3/2019 | Vandenberg | |
| 10,220,497 | B2 | 3/2019 | Vandenberg | |
| 2001/0030138 | A1 | 10/2001 | Bruins et al. | |
| 2001/0054635 | A1 | 12/2001 | Schmitz | |
| 2003/0015565 | A1 | 1/2003 | Lee | |
| 2003/0057248 | A1 | 3/2003 | Bruins et al. | |
| 2003/0102350 | A1 | 6/2003 | Liu et al. | |
| 2003/0213829 | A1 | 11/2003 | Bruins et al. | |
| 2006/0289597 | A1 * | 12/2006 | Bruins | B25C 5/1693 227/18 |
| 2008/0017686 | A1 | 1/2008 | Buck | |
| 2008/0093412 | A1 * | 4/2008 | Vanden Berg | B25C 5/1693 227/132 |
| 2010/0019014 | A1 * | 1/2010 | Rodenhouse | B25B 23/10 227/135 |
| 2011/0100659 | A1 * | 5/2011 | Murate | E02D 7/16 173/104 |
| 2012/0241490 | A1 * | 9/2012 | Busch | A01K 11/002 227/76 |
| 2013/0087023 | A1 | 4/2013 | Vandenberg | |
| 2013/0219690 | A1 | 8/2013 | Vandenberg | |
| 2019/0055738 | A1 | 2/2019 | Vandenberg | |
| 2019/0055974 | A1 | 2/2019 | Vandenberg et al. | |

FOREIGN PATENT DOCUMENTS

| | | | |
|---|---|---|---|
| EP | 2517834 | A2 | 10/2012 |
| MY | 166977 | A | 7/2018 |
| WO | 9939878 | A | 8/1999 |
| WO | 2017142979 | A2 | 8/2017 |
| WO | 2019036146 | A1 | 2/2019 |

* cited by examiner

HYBRID CORDLESS CAP TOOL

BACKGROUND OF THE INVENTION

The present invention relates to a construction tool adapted to apply caps and fasteners, and more particularly to a tool that drives a fastener through a cap to fasten the cap to a substrate.

In the construction industry, certain tools have been developed that are used to secure fabric, sheet material, and/or panels (collectively "panels") to an underlying substrate, such as a wall, a roof or other surface. To adequately secure the items, a combination of a nail or staple with a flat, rather large diameter cap is used. The nail is driven through the cap, and that combined unit engages the panel, with the nail piercing the panel and entering the substrate. The larger diameter cap increases the surface area of the nail/cap combination engaging the panel to better secure the panel to the substrate.

Conventional tools that simultaneously apply a nail and a cap come in two primary forms. One of those forms is a pneumatically operated tool. This tool typically includes a system of air conduits that are plumbed to provide pressurized air which advances the caps and nails to a nose piece. The air conduits also provide pressurized air to drive the nail through the cap and into the underlying panel and/or substrate. While these tools are powerful and durable, they are many times unwieldy because they always have an air hose attached to the tool. This adds weight to the tool. In addition, users can many times cut or damage the air hose on a job site, which then requires repair of the hose to use the tool, which in turn leads to down time and added labor costs.

Another form of such tools are hammer type tools. This tool readies a cap in position when a weight inside the tool moves after impact of the tool. While it frees the tool from an unwieldy air hose, this tool can have issues as well. For example, in some cases, where the tool is not swung hard enough, the weight might not properly advance a cap or a nail. In other cases, when the tool is dropped, it might inadvertently jam. In yet other cases, where improper caps are used, the tool might require a different swing stroke to adequately drive the nail and cap.

As can be seen above, conventional pneumatic cap nailers and manual cap nailers can have their benefits and shortcomings. Accordingly, there remains room for improvement in the field of tools that apply caps and fasteners in combination.

SUMMARY OF THE INVENTION

A tool and related method are provided that use stored mechanical energy to advance caps and/or fasteners, and an onboard power source to drive a fastener through a cap and into a substrate.

In one embodiment, the tool can administer a fastener and an associated cap to secure fabrics, paper, sheets, panels and/or other substrates. The tool can be a hybrid tool that utilizes: a) energy stored in a biasing element, such as a spring, the energy harvested upon engagement of the tool with a surface, to move a cap and/or a fastener toward a fastener driving path, and b) energy stored in a power source, such as a battery, to advance the fastener through the cap thereby applying the fastener/cap combination to a substrate. The hybrid tool can utilize both energy harvested from mechanical motion and energy stored in an onboard power source to function.

In another embodiment, the tool can include a nose assembly, a bell crank rotatably joined with the nose assembly, and a pressure foot. The pressure foot can be configured to engage a substrate thereby transferring movement to the bell crank so that the bell crank is urged to a ready mode against a force of a biasing element.

In still another embodiment, the force of the biasing element moves the bell crank during an advance mode when the pressure foot is moved away from the substrate such. In the advance mode, the bell crank indirectly urges at least one fastener toward the fastener driving path, and indirectly urges at least one cap toward the fastener driving path.

In yet another embodiment, the driving unit is configured to move a blade during a driving operation along the fastener driving path to drive a fastener to pierce through a cap and into the substrate, thereby joining the combined fastener and cap with the substrate.

In a further embodiment, the tool includes a fastener arm rotatably joined with the bell crank. The fastener arm can be joined with a fastener tooth configured to directly engage a fastener on a fastener guide that carries the fasteners toward the fastener driving path.

In still a further embodiment, the tool includes a cap arm rotatably joined with the bell crank. The cap arm can be joined with a cap tooth configured to directly engage a cap on a cap guide that carries the caps toward the fastener driving path.

In still a further embodiment, the tool includes a rechargeable battery electrically coupled to the driving unit. The driving unit is powered by the rechargeable battery to operate an electric motor to move a blade disposed in a barrel of the nose assembly, along a fastener driving path. The blade engages a fastener in the fastener driving path, and advances it through the barrel so as to pierce a cap in the fastener driving path.

In yet a further embodiment, a method is provided. The method can include pressing a pressure foot of the tool against a substrate to rotate a bell crank, the bell crank thereby moving a cap tooth along a cap guide and a fastener tooth along a fastener guide, and biasing a biasing element; actuating a driving unit with electricity from a power source; driving a fastener with the driving unit along a fastener driving path so that a first fastener pierces a first cap; moving the pressure foot away from the substrate so that the bell crank rotates under a bias force produced by the biasing element. When the bell crank rotates under the bias force, a cap tooth can advance a second cap toward the fastener driving path, and a fastener tooth can advance a second fastener toward the fastener driving path.

The current embodiments provide a tool and method having functionality that previously was unachievable. The tool is sustainable, harvesting and utilizing mechanically input energy, as well as energy from a rechargeable battery. The mechanically input energy can be stored in a biasing element and used by the bell crank and other components to advance caps and fasteners. The power source and its stored energy can be conserved and utilized primarily only to advance a fastener in the nose assembly through a cap. The power source thus need not be consumed to move the caps and fasteners in such a construction. Where the power source is a rechargeable battery, it can be recharged multiple times to advance many fasteners on a job site or during a construction project. The power is not consumed in such a case by too many functions. The movement of the tool also is efficiently harnessed to harvest input energy and forces to move the caps and fasteners.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
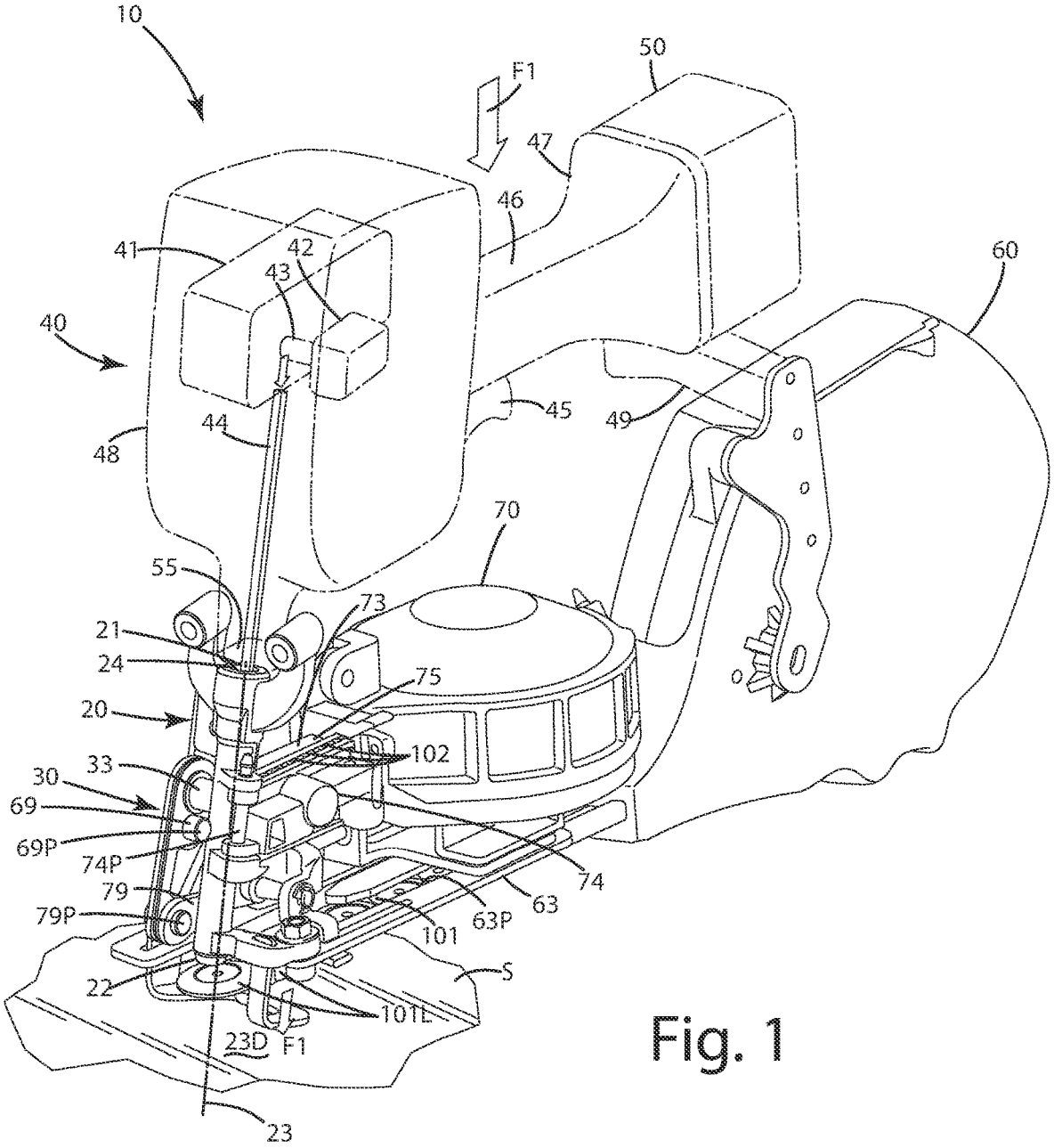
FIG. 1 is a front perspective view of the tool of a current embodiment.

A current embodiment of a tool of a current embodiment is shown in FIGS. 1-9 and generally designated 10. The tool 10 can be utilized to feed fasteners 102 and caps 101 sequentially toward a nose assembly 20 of the tool, in particular, into the line of a fastener driving path 23 that intersects a fastener driving station 23D. The movement of the fasteners and the caps is provided via the bell crank 30 of the tool 10 that uses mechanical energy input by movement of the tool 10 and stored in a biasing element. The bell crank uses that mechanical energy to move elements that engage the fasteners and the caps respectively and move them toward a discharge station 23, and more particularly, into the fastener driving path 23. When a particular fastener and a cap, for example, a leading fastener 102L and a leading cap 101L are disposed in the fastener driving path 23, the driving unit 40 of the tool 10 can be powered via a power source 50 that is joined with the tool. The power source can be actuated to cause the driving unit to advance a blade or other type of striker within the nose assembly 20, thereby contacting the leading fastener 102L, driving it through the fastener station 23D along the fastener path 23 so that it penetrates the leading cap 101L and is driven into an underlying substrate S.

With the arrangement of the tool, the tool can be operated utilizing both mechanically input energy stored in a biasing element, and electrical energy stored in a power source, such as a battery. In this manner, the energy stored in the battery can be conserved, because it can be utilized primarily for only for the function of driving the fastener, rather than advancing the caps and/or the fasteners toward the driving station. As used herein, power source can refer to a rechargeable battery, a capacitor, a lithium-ion battery, an alkaline battery, or any other type of power source capable of storing a charge and/or electricity. The power source can be separated from any type of electrical cord so that the power source and the tool is cordless, that is, without a cord extending therefrom to a power outlet, or a pneumatic or a hydraulic input such as an air compressor or a hydraulic pump.

The tool 10 can be utilized to advance a fastener and cap combination into an underlying substrate S. The substrate S can be and/or include a panel, a textile, a fabric, a sheet, a film, or other materials, which can be used for roofing, siding, insulation, or other construction applications. The cap and fastener combination can be utilized to fasten the substrate to an underlying structure, such as a roof, a deck, a wall, or some other type of support.

The various components of the tool 10 will now be described in detail. With reference to FIG. 1, the tool 10 can include a driving unit 40. This driving unit can be a highly modified and reconfigured cordless nailer, such as a framing nailer, a brand nailer and/or a stapler. One optional driving unit that can be modified according to the current embodiment can be a DeWalt XR 20 Volt Max 16 GA nailer, available from Stanley Black & Decker, Inc. of Towson, Md. The driving unit 40 can include an electric motor 41 that can rotate a spool 42 having a striker tooth 43. The striker tooth 43 can strike a striker 44, also referred to as a blade herein, which in turn moves the blade 44 along a fastener driving path 23 toward a fastener driving station 23D. The electric motor 41 can be actuated via a trigger or manual actuator 45 that starts the motor 41 and allows the power source 50 to convey electricity or voltage to the electric motor 41. The driving unit 40 can include a housing 48. The above noted electric motor 41, striker tooth 43 and blade 44 can be at least partially housed in the housing 48. The housing also can include a grip 46 that extends from the housing 48 away from a nose assembly 20, which is not part of the exemplary driving unit noted above.

The grip 46 can include a first end proximal the driving unit 48 and a second end 47 distal from the driving unit. The second end 47 of the grip or driving unit can be joined with power source 50, which can be a rechargeable battery. The rechargeable battery 50 can be electrically coupled to the driving unit 40, for example, to the electric motor 41. The driving unit, for example the electric motor, can be powered by the rechargeable battery to move the blade 44, by rotating a spool and engaging the striker tooth against the blade. Of course, other types of driving units that are operated by a power source, such as a rechargeable battery, can be substituted for the exemplary driving unit 40 noted above.

The battery 50 can be removable relative to the driving unit 40. The battery 50 can include connectors that allow it to be mechanically and electrically coupled to the housing 48, which will not be described in detail here. Suffice it to say that the battery or power source 50 can be removable relative to the driving unit 40 so that the battery can be recharged, serviced, or traded out for another battery.

The power source 50, as illustrated, can be utilized for a primary function, that is, to advance a fastener through a cap and into a substrate. Optionally, the energy stored in the power source or battery 50 is conserved for that main function. It optionally is not utilized for other functions, for example, it might not be used to convey the fasteners and/or caps toward the discharge station 230. In this manner, the energy, for example, the charge or electricity, stored in the battery can be conserved for driving and advancing the fastener. To perform other functions, such as advancing the fasteners and/or the caps, mechanical energy can be input by moving parts of the tool, for example, manually by user, and storing that mechanically input energy in a biasing element, for example, a spring as described below. On a high level, the biasing element can store energy input into the tool via a mechanical structure, and that energy can be used for certain function(s) of the tool, while the battery can store electrical energy in the tool, and that energy can be used for other function(s) of the tool.

Figure 2:
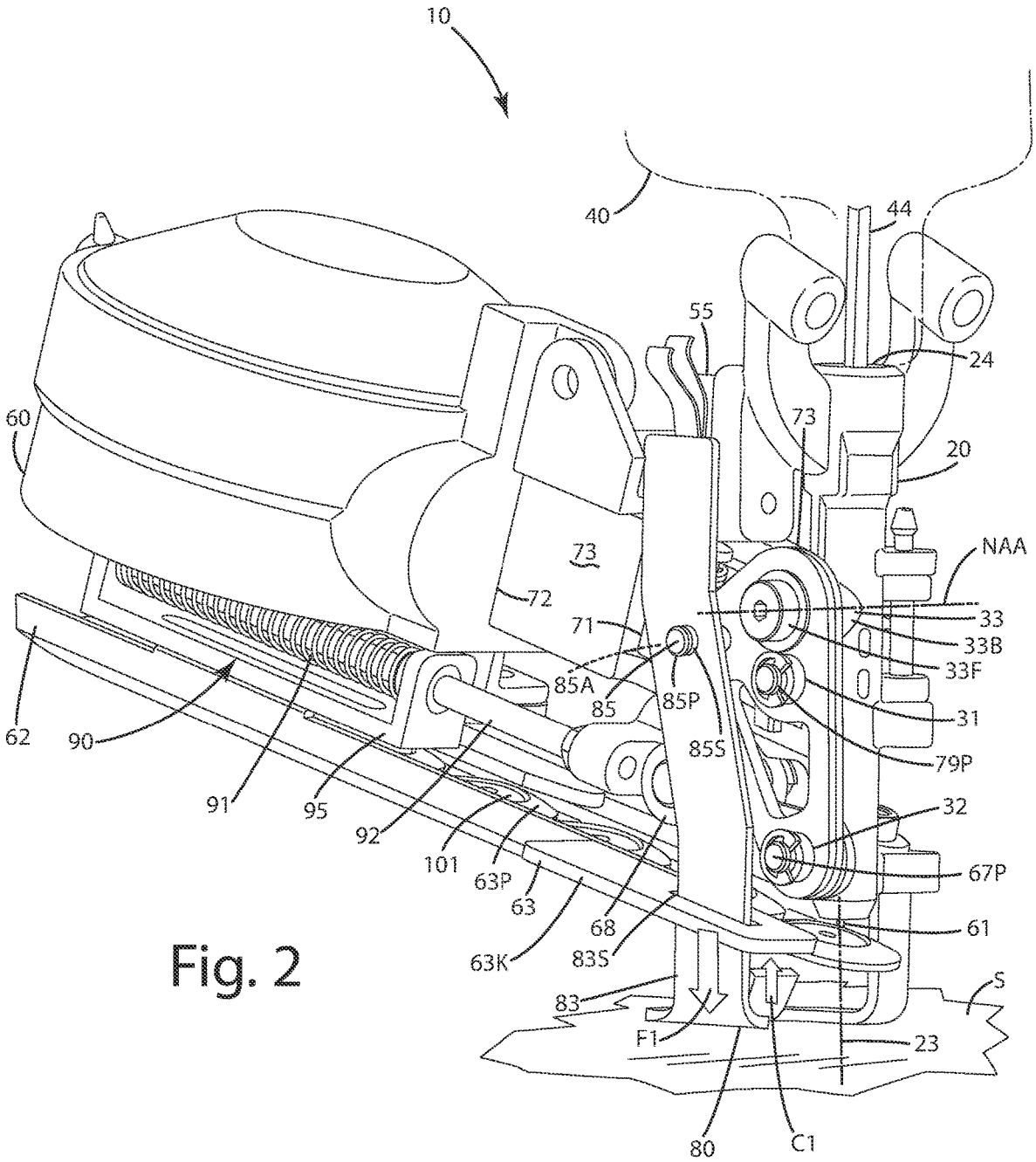
FIG. 2 is a front perspective view of the tool in a neutral mode.
Figure 3:
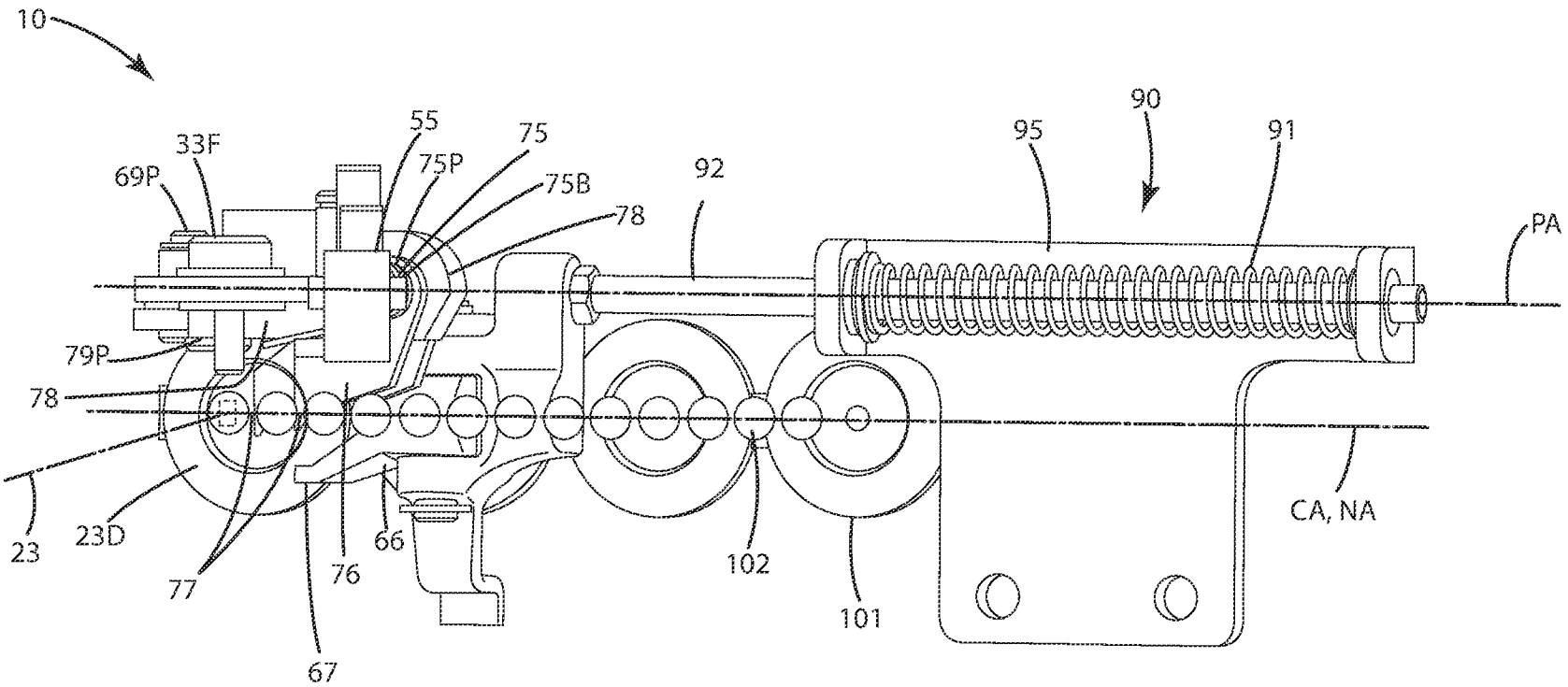
FIG. 3 is a top view of the tool in the neutral mode.
Figure 4:
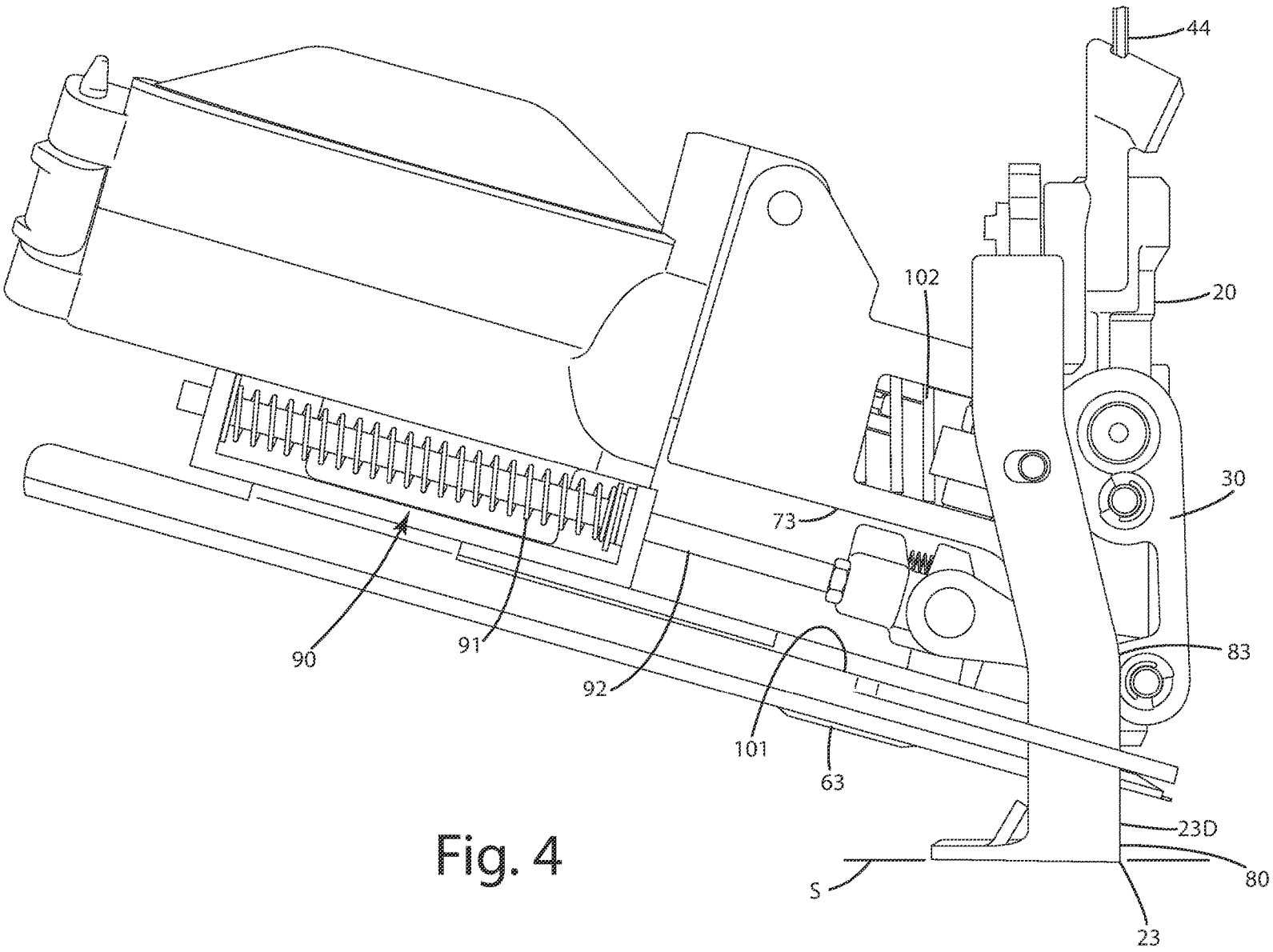
FIG. 4 is side view of the tool in the neutral mode.
Figure 6:
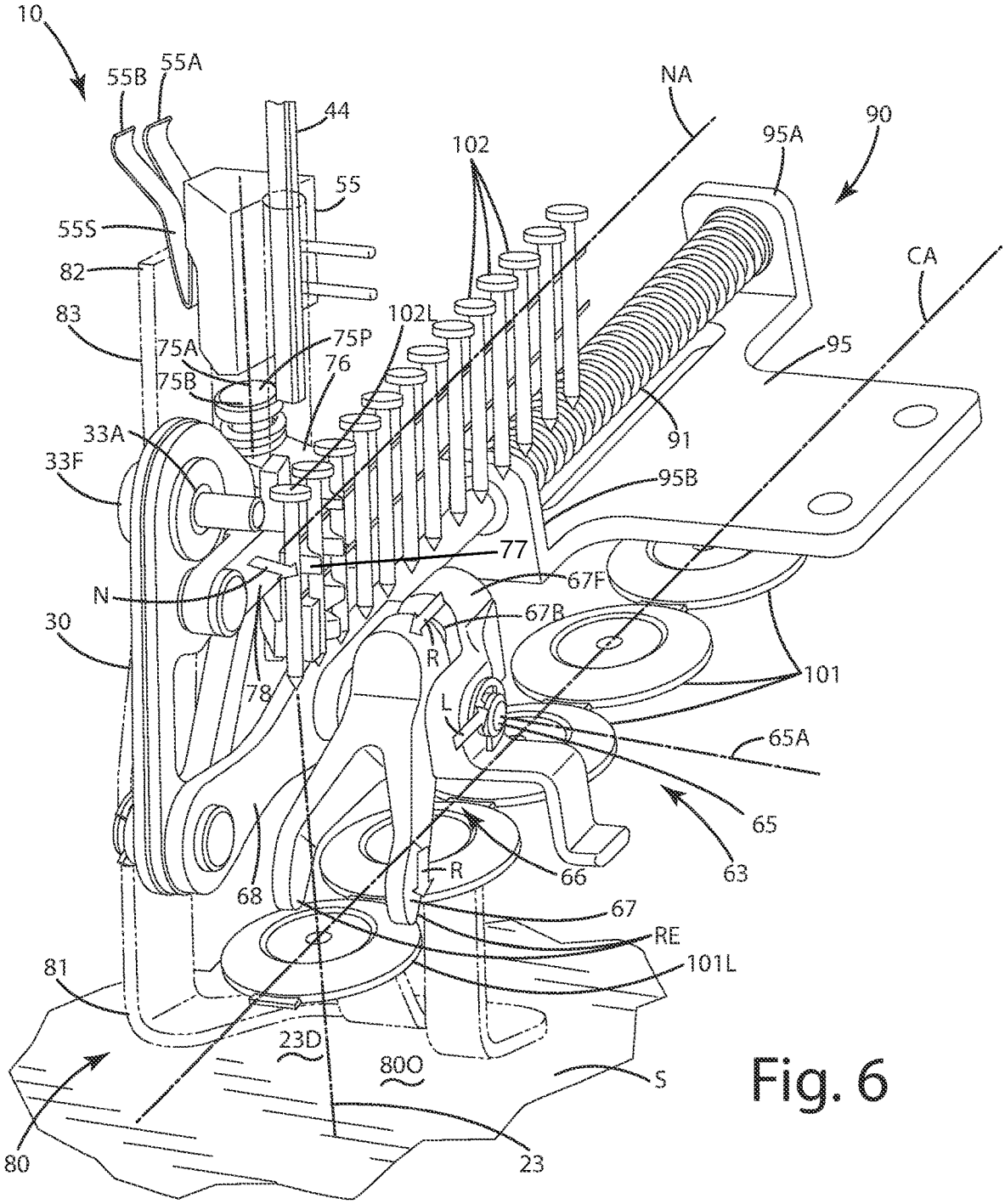
FIG. 6 is a front perspective view of parts of the tool in the neutral mode.

Optionally, the driving unit 40 and its electrical circuitry and/or components can be at least partially controlled by a safety switch 55. The safety switch 55 can be mounted to the nose assembly 20 as shown in FIGS. 2, 3 and 6. The safety switch 55 can be in electrical communication with the motor 41 of the driving unit 40. The safety switch can be coupled to the electric motor so that the blade 44 only moves when the safety switch is engaged by a component of the tool 10. Optionally, the switch 55 can include contacts 55A and 55B. These contacts can be aligned with a portion of the bell crank 30 and/or a portion of the foot assembly 80, such as a leg 83 of the pressure foot. This leg 83 and/or the bell crank 30 can be configured to move one or more of the contacts 55A and 55B so that they engage a button 55S of the switch. The switch 55 can be a toggle switch, a pressure switch, a lever or other type of electrical switch. The switch can be in communication with the electric motor 41 as noted above, such that when the contacts are in the configuration shown in FIG. 6, the switch 55 will not allow the electric motor 41 to move the blade 44, or to otherwise allow the blade 44 to move in the fastener path 23. These contacts can be physically engaged by movement of the leg 83, for example, when the upper end 82 of the leg engages the contacts and provides an electrical contact between the two, or otherwise depresses the switch 55S. When this occurs, the switch 55 can enable the drive unit to engage the blade 44, moving it in the barrel 24 of the nose assembly 22 to strike or otherwise engage the fastener in the fastener driving path 23. In some applications, the safety switch can be associated with other moving components of the tool. In other cases, the safety switch can be eliminated or integrated into the system in another manner.

The different parts of the driving unit 40 and the battery 50 can be disposed over or adjacent other components of the tool 10. For example, as illustrated in FIG. 1, the distal second end 47 of the grip element and the driving unit 40 can be joined via a support bracket 49 to a cap magazine 60. This cap magazine can be disposed directly under the power source 50 when it is installed relative to the driving unit 40. Thus, the cap magazine can be disposed directly under the battery of the tool. The grip element also can extend above the cap magazine 60, the cap guide 63, as well as a portion of the fastener magazine 70 as described below.

The driving unit 40 can be joined with the nose assembly 20. The nose assembly 20 can be further joined with the bell crank 30, which is described below. The nose assembly 20 can form a structure to which multiple components can be joined. The nose assembly 20 can define internal barrel 24 having a first end 21 and a second end 22. The first end 21 can be disposed adjacent or proximal to the driving unit 40. The blade 44 can extend into the first end 41 and at least partially through the barrel 24. The second end 22 of the barrel can be the portion of the barrel through which a fastener is advanced by the blade 44, through a cap 101L and into an underlying substrate S.

The cap magazine 60 and the fastener magazine 70 can be joined with the nose assembly 20 via a cap guide 63 and a fastener guide 73. The cap magazine 60 can be joined with the nose assembly 20, and the driving unit 40, via the cap guide and the cap magazine support 49. The cap magazine can contain a cap strip including multiple caps 101 that are joined edge to edge, and aligned along the cap guide 73 leading toward the fastener driving path 23. A leading cap 102L can be disposed below a leading fastener 101L. A driving operation can be performed by the blade 44 striking the fastener and driving it through the cap as described below. The cap magazine can store a roll or spool of multiple caps. The caps can be individual disk-shaped caps that are positioned in edge-to-edge configuration, with adjacent caps being interconnected by small webs or tabs that join the peripheral edges of those caps. This in turn forms the elongated cap strip. The cap webs can be formed from a polymer material constructed via molding or extruding processes. Of course, the individual caps can be formed from other materials depending on the application. The caps 101 can have a domed configuration in cross-section with the underside of the caps having a shallow concave recess, and the upper surface of the caps having a shallow convex configuration. The caps 50 constructed can resiliently flex in the middle of the cap when a fastener is driven therethrough to provide increased gripping engagement between the periphery of the cap and a substrate which is engaged thereby. Although described in connection with a roll of caps connected edge to edge, the tool also can be used in conjunction with multiple caps that are stacked one atop the other and that are fed one by one, individually along a cap guide toward the fastener driving path 23. Other types of arrangements and configurations of caps can be utilized in conjunction with the tool 10.

The cap magazine can be connected to the nose assembly 20 via the cap guide 63. The cap guide can include a first end 61 that is joined with the nose assembly 20. A second end 62 of the cap guide 63 can be joined with the cap magazine 60. The cap guide 63 can define a passageway 63P that extends from the cap magazine 60 toward the discharge station 23D. This passageway 63P can generally be C-shaped and can have a height that is only slightly greater than the height of the caps 101 so as to enable the cap strip to slidably move within the passageway 63P, yet still be constrained within the passageway to prevent bunching, kinking or abnormal movement of the strip of caps 101.

As shown in FIG. 6, the cap guide 63 can be associated with or otherwise include a cap feeder 66. This cap feeder 66 can include a one or more cap teeth 67. The cap teeth 67 can engage the edges of individual ones of the caps 101 within the guide 63. The one or more cap teeth 67 can engage the rearward edge RE of a leading cap 101L and push it into the discharge station 23D. This cap tooth 67 can be rotatably mounted to a cap feeder pivot pin 65. The cap feeder pivot pin 65 can rotate about an axis 65A that is generally perpendicular to the cap axis CA and the fastener axis NA. The cap feeder pivot pin 65 can be joined with a cap arm 68 as described further below. The cap feeder 66 also can include a cap feeder tooth bias element 67B that generally biases the tooth 67 downward, toward a bottom of the cap guide 63 as shown in the direction of arrows R in FIG. 6. This in turn allows the cap tooth 67 to ride up and over the upper surfaces of the caps in the cap strip 101 and then drop down into recesses between the caps, against a rear edge of a cap, to push that cap toward the discharge station 23D. The bias element 67B can be a coil spring that is disposed between a fixed part 67F of the cap feeder 66 or the cap tooth 67 which is movable and rotatable about the cap pivot axis 65A or cap pivot pin 65. The pivot pin 65 and the cap teeth 67 associated with the cap feeder 66 can reciprocate back and forth in directions L as shown in FIG. 6 to sequentially feed the caps 101 toward the discharge station 23D and into the fastener driving path 23.

The cap guide 63 can guide the strip of caps along a cap axis CA that leads to the discharge station 23D and that is transverse or generally perpendicular and orthogonal to the fastener driving path 23 as shown in FIG. 3. The cap axis CA can be parallel to the fastener axis NA on which the strip of collated fasteners 102 as described below travels. The cap axis CA can be offset laterally from but parallel to a piston axis PA as described below. The cap axis also can be generally parallel to the fastener axis NA, but located directly below the fastener axis NA, a distance that is at least as great as the length of a fastener within the strip of fasteners 102.

As mentioned above, and with reference to FIGS. 1 and 2, the tool 10 can include a fastener magazine 70. This fastener magazine can be configured to hold a supply of collated fasteners that are joined to one another via a web, strip or other configuration. The fasteners can be in the form of nails, brads, spikes, staples or other elongated fasteners, and in some cases can be rotatable fasteners, such as screws and the like, depending on the application. The fastener magazine 70 can contain and store the supply of multiple fasteners in the form of a roll or spool. The fasteners can be guided from the fastener magazine 70 to the nose assembly 20, to the barrel 24 and within the fastener driving path 23 via a fastener guide 73. This fastener guide 73 can include a first end 71 that is joined with the nose assembly 20 and a second end 72 that is joined with the fastener magazine 70. The fastener guide 73 can include a track 75 that is disclosed via a door 74. The track 75 and the door 74 can form an elongated channel generally in the shape of the fasteners so the fasteners can be easily conveyed to the nose assembly 20 and in particular the barrel. The door 74 can be pivotable about a pivot pin 74P so as to provide access to the interior of the guide and any fasteners that might be stuck or jammed therein.

As shown in FIG. 6, the fastener guide 73 can be associated with or otherwise include a fastener feeder 76. This fastener feeder 76 can include a one or more fastener teeth 77. These fastener teeth 77 can engage the shafts of individual ones of the fasteners 102 within the guide 73. The one or more fastener teeth 77 can engage the leading fastener 102L and in particular its shaft and push it toward the discharge station 23D and the fastener driving path 23. The one or more fastener teeth 77 can be rotatably mounted to a fastener pivot pin 75P. This fastener pivot pin 75P can be rotatable about an axis 75A that is generally parallel to the fastener driving path 23 but generally orthogonal to or perpendicular to the pin pivot axis 65A. The fastener feeder pivot pin 75P can be joined with a fastener cap arm 78 that is described below. The fastener feeder 76 also can include a fastener tooth bias element 75B that biases the one or more teeth 77 outward, toward the nail axis NA along which the fasteners 102 move. The bias element 75B can be in the form of a coil spring that is coiled to urge the fastener teeth 77 in direction N. The teeth can be ramped so that as the fasteners push against the teeth, the teeth move out of the way, biasing the bias element 75B, to allow the teeth 77 to move into the next gap adjacent the next fastener moving toward the fastener driving path 23. The pivot pin 75P and the teeth 77 associated with the feeder 76 can swing toward and away from the multiple fasteners 102 as those fasteners move along the fastener path NA to sequentially feed the fasteners 102 toward the discharge station 23D and into the fastener driving path 23.

The mechanical assembly that moves during use of the tool 10 to produce mechanical energy that is temporarily stored by the tool will now be described with reference to FIGS. 1-6. A primary component of this mechanical assembly is the bell crank 30. The bell crank 30 can be mounted to the nose assembly 20. In particular, the bell crank 30 can be rotatably mounted to nose assembly 20 at a nose assembly pivot element 33. The nose assembly pivot element 33 can include a threaded boss 33B that extends laterally from the nose assembly 20. The boss 33B can be threaded. A fastener 33F can extend through a nose assembly pivot element aperture 33A defined by the bell crank 30 and can be threaded into the threaded boss 33B. A portion of the fastener 33F can include a bearing or a bushing so that the bell crank 30 can rotate about the portion of the fastener 33F that extends through the aperture 33A. Of course, in other applications, the boss 33B can be replaced with a pin or a post having a bushing mounted thereto. There bushing or post can extend through the aperture 33A and a nut or other fastener can be attached to the end of it to secure the bell crank rotatably to the nose assembly 20. Generally, the bell crank rotates about the nose assembly pivot axis NA throughout its operation and function to assist in the storage of mechanical energy input by movement of the tool.

Optionally, the bell crank 30 can be in the form of a first elongated plate arranged adjacent the nose assembly 20 and adjacent the barrel 24 that houses the blade 44 when the blade moves along the fastener driving path 23. The elongated plate can be substantially parallel to the fastener driving path 23, which can coincide with a centrally located axis of the barrel 24. The bell crank 30, in particular the elongated plate of the bell crank, can define a first hole 31 and a second hole 32 below the aperture 33A. The first hole 31 can be associated with a first pivot 79P which is further associated with fastener arm 78 which is further joined with the one or more cap teeth 77 as described below. The second hole 32 can be associated with a second pivot 69P which is further associated with the cap arm 68, which is further joined with the one or more cap teeth 67 as described below. The first pivot 79P can include a first post rotatably disposed in the first hole 31. The second pivot 69P can include a second post rotatably disposed in the second hole 32. Each of these respective posts can extend through corresponding holes defined by the respective fastener arm 78 and the cap arm 68. Thus, each of the fastener arm 78 and cap arm 68 can be rotatable relative to the bell crank 30 and the respective first and second pivots. Optionally, the posts can be in the form of pins that are secured with e-clips or other fasteners. In other cases, the posts can be in the form of fasteners that are simply threaded into the bell crank and the respective holes 31 and 32.

Figure 5:
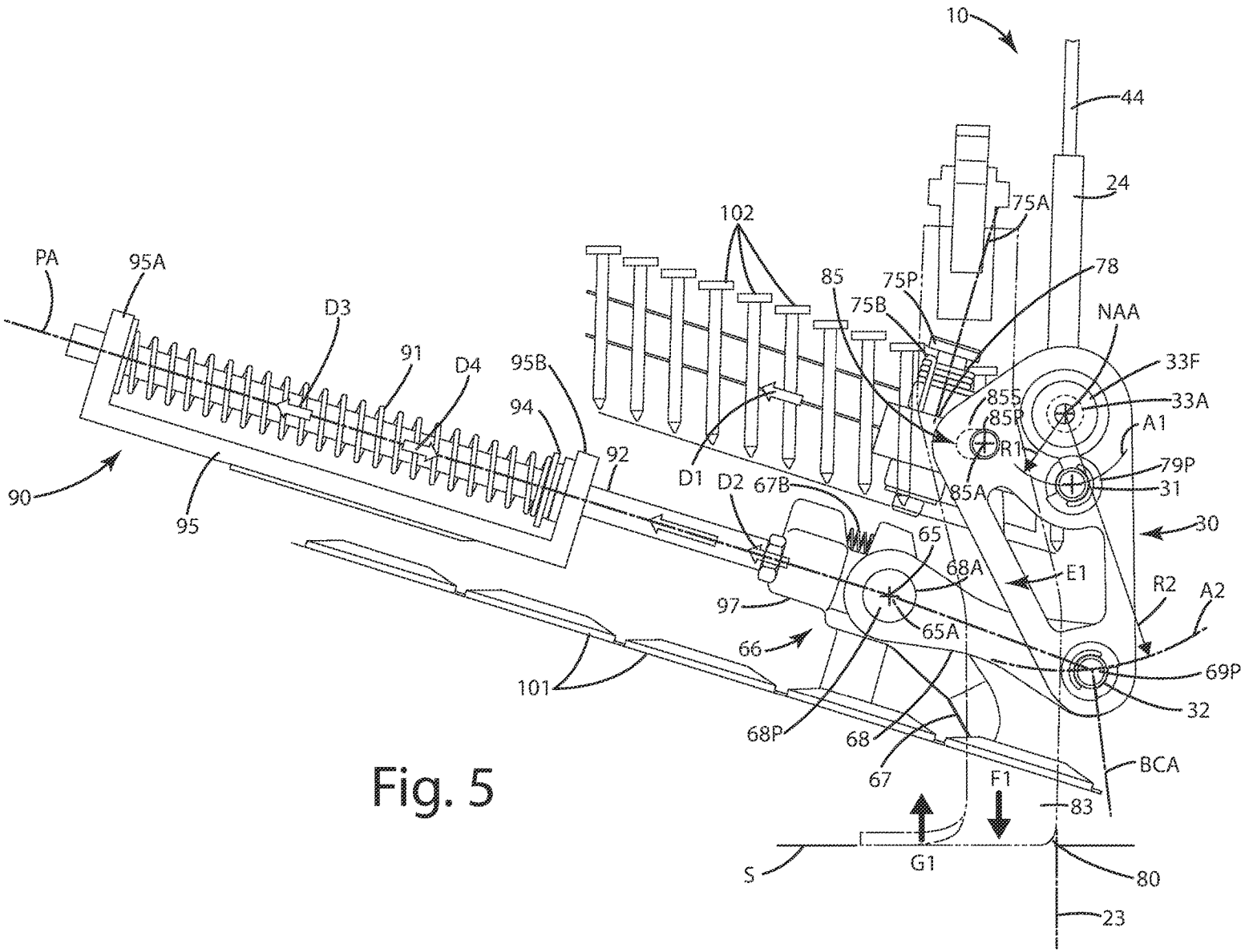
FIG. 5 is side view of parts of the tool in the neutral mode.

Further optionally, the holes 31 and 32 can lay on a common axis, that is, a bell crank axis BCA shown in FIG. 5, with the bell crank aperture 33A. Thus, all of the axes of the respective posts or pins that are disposed through the respective holes and apertures also can lay on this bell crank axis BCA. The relationship of the holes and their axes can be set up in a manner to efficiently move the respective fastener arm and cap arm. As one example, the nose assembly pivot axis NAA can be configured so that a first arc A1 is disposed at a first radius R1 from the pivot axis NAA and so that a second arc A2 is disposed at a second radius R2 from the axis. The second radius R2 can be greater in length than the first radius R1. In some cases, the ratio of radius R2 to R1 can be optionally at least 2:1, further optionally at least 2.5:1, yet further optionally at least 3:1, even further optionally between 1:1 and 7:1, inclusive, still further optionally between 2:1 and 6:1, inclusive. Further optionally with such ratios of the radii, the bell crank can incrementally move the fastener teeth 77 a shorter linear distance along the fastener axis NA then the bell crank moves the feeder teeth 67 along the cap axis CA as the bell crank rotates about the axis NAA. This can be helpful where the shafts of the fasteners are placed closer to one another, then the centers of the caps are placed relative to one another, to promote structured and precise spacing and movement of the respective fasteners and caps.

Optionally, the bell crank axis BCA can be substantially parallel to the fastener driving axis 23 and the fastener pivot pin axis 75P at some point during the rotation of the bell crank 30 about the pivot axis NAA.

As mentioned above, the bell crank 30 can be rotatably mounted relative to the nose assembly 20. As shown in FIGS. 1, 2 and 5, the fastener arm 78 and the cap arm 68 can be rotatably and pivotally mounted to the bell crank 30 in particular at the respective first pivot 79P and the second pivot 69P. As illustrated, the fastener arm 78 can be shorter than the cap arm 68. The fastener arm 78 can be configured to move substantially parallel to the fastener guide 70 and its respective track 75. The cap arm 68 can be configured to move substantially parallel to the cap guide 60 and its respective track 65. As mentioned above, the fastener guide and cap guide can be substantially parallel to one another, with the fastener guide located above the cap guide. The fastener arm 78 can extend rearward from the first pivot 79P in the first direction D1. The cap arm 68 can extend rearward from the second pivot 69P in a second direction D2. The first direction D1 and a second direction D2 can be substantially parallel to one another, particularly when the tool 10 is in the neutral mode shown in FIGS. 1-6.

The fastener arm 78, as mentioned above, can extend rearward from the first pivot 79P alongside the nose assembly 20. The fastener arm 78 can extend rearward to the second end which includes the fastener feeder pin 75P rotatably mounted relative to the second end of the fastener arm 75. This fastener pivot pin 75P can be biased by the biasing element 75B, which as noted above can be a coil spring. The fastener pivot pin 75P can include an axis 75A which can be substantially vertical, but angled relative to the fastener driving axis 23. The axis 75A also can be offset relative to the angles of the shafts of the fasteners 102. The fastener teeth 77 can be rotatably mounted to the fastener pivot pin 75P. Thus, the fastener teeth 77 can effectively rotate about the axis 75A, when engaging and disengaging the fasteners 102 as the bell crank 30 transitions from the neutral mode shown in FIGS. 1-5 to the ready mode shown in FIG. 7.

The cap arm 68 can extend rearward in direction D2 toward a third pivot 65. This third pivot 65 can be in the form of a cap pin disposed through an aperture 68A defined by the cap arm 68. The pivot 65 can be joined with the feeder 66, and as discussed above, the cap teeth 67 can be rotatably joined with the cap arm 68 generally at the third pivot 65. The cap tooth 67 also can rotate and/or pivot about the pivot axis 65A. The cap tooth 67 can be configured to slide over individual ones of the multiple caps 101, when the bell crank 30 moves with the cap arm 68 as described below.

As shown in FIGS. 2-5, the tool 10 can include a biasing element 90. This biasing element 90 optionally can include a coil spring 91 and a piston 92. The piston 92 can be joined with the cap pivot pin 65 which is further joined as mentioned above with the cap arm 68 and thus the bell crank 30. The bell crank can move the cap arm, which in turn can move the biasing element, for example by pushing the piston 92 toward the spring 91. The piston 92 can be in the form of an elongated rod including a washer 94 that engages an end of the coil spring 91. The coil spring 91 can be captured between arms 95A and 95B of the bracket 95. The bracket 95 can be further mounted to the tool, for example, to the nose assembly 20 and/or the fastener track 75 or some other component of the tool 10. The biasing element 90 can store mechanical energy, input via engagement of the pressure foot 80 with a surface S, which energy in turn can be utilized to rotate the bell crank 30 about the axis NAA. For example, the bell crank 30 can engage the cap arm 68 to move it in direction D2, which in turn causes the piston 92 to move along the piston axis PA in direction D3, which in turn pushes the washer 94 against the coil spring 91, thus compressing the coil spring 91 to store the mechanical energy therein which is later utilized to move the piston, the cap arm and the bell crank in direction D4 and thus rotate the bell crank 30 as described below.

Although the biasing element 90 is illustrated as including a piston joined with a coil spring, the piston itself optionally can be absent, and the coil spring can directly engage the cap feeder 66 and/or the cap arm 68. In other cases, the biasing element 90 can include an elastomeric element or other compressible material that directly engages the cap arm 68, the bell crank 30 and/or the feeder 66. When the elastomeric element or compressible material is compressed, it can store the energy, and return it to the bell crank to move the respective cap teeth and fastener teeth.

Figure 10:
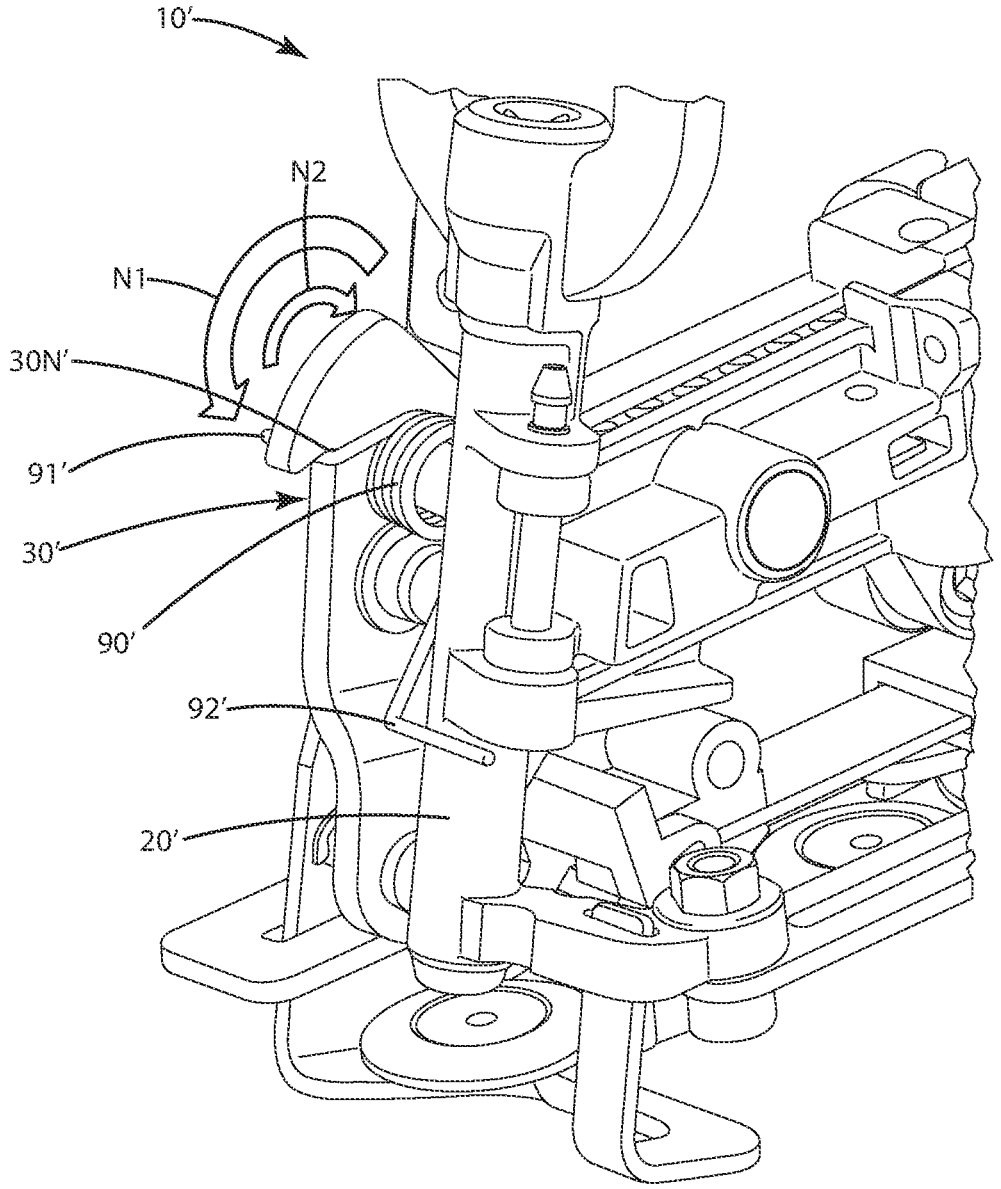
FIG. 10 is an alternative embodiment of the tool including a torsion spring that engages a bell crank of the tool.

Optionally, the biasing element 90 can be associated directly with the bell crank. For example, as shown in an alternative construction of the biasing element 90' in FIG. 10, the biasing element 90' can be in the form of a coil spring that is mounted to the nose assembly 20' of the tool 10'. The coil spring 90' can be wrapped around the nose assembly pivot element 33'. The coil spring can include a first tang 91' and a second tang 92'. The first hang 91' can be disposed in a notch 30N' of the bell crank 30'. The second tang 92' can engage the nose assembly 20'. Thus, when the bell crank rotates in direction N1, the biasing element 90' stores energy therein and can return it to the bell crank and mechanically rotate the bell crank in direction N2. As a result, the respective cap teeth and fastener teeth can move the respective caps and fasteners as described herein.

Returning to the embodiment illustrated in FIGS. 1-9, the bell crank can be mechanically moved by the pressure foot 80 and the associated leg 83 when the pressure foot 80 engages the substrate S or a force applied by a user moving the tool 10 toward the substrate S. The pressure foot 80 can include an opening 800 that can be aligned with the discharge station 23D so that a fastener and a cap can be administered to the substrate S at least partially through the opening 800. The pressure foot 80 can extend upward and can be joined with the leg 83. The leg 83 can be in the form of a second elongated plate, which can be substantially parallel to the bell crank when in the form of the first elongated plate. The leg can be substantially parallel to the bell crank 30. The leg 83 further can be substantially parallel to the fastener driving path 23 and can be transverse to the cap axis CA and the fastener axis NA as well as generally transverse to the cap guide 63 and the fastener guide 73. The leg can be substantially parallel to the barrel 24 of the nose assembly 20, as well as the fastener driving path 23. The leg 83 can extend upward and generally transverse to the first direction D1 and to the second direction D2 of the respective fastener arm and cap arm movement.

The leg can be journaled in a slot 83S defined by a plate 63K that is joined with the cap guide 63. Of course, this plate 63K alternatively can be joined with the nose assembly 20. The slot can guide movement of the leg 83 when the pressure foot 80 engages the substrate S. The leg 83 as mentioned above can extend upward and can transfer movement of the pressure foot when it engages the substrate through the leg 83 to the bell crank 30 via an input 85. Optionally, this input 85 can include a post 85P that can be both rotatable and linearly slidable in a slot 85S. The post can extend from the bell crank through at least a portion of the slot 85S. The post itself can be joined directly to the bell crank. Slot 85S can be defined by the leg 83. As illustrated, the slot can be an elongated slot having a length of at least 1.5 times a diameter of the post. The slot can be elongated, rather than a simple circular hole, so that the post 85P can linearly slide along the length, and can move at least partially linearly within the slot 85S, while the post 85P simultaneously rotates within the slot 85S and simultaneously while the bell crank 30 rotates about the axis NAA. Generally, the leg 83 moves substantially linearly beside the bell crank 30, while the bell crank 30 rotates about the nose assembly pivot element 33 and the axis NAA. With the post being able to move linearly in the elongated slot and rotate in that slot, during conversion of the bell crank from a neutral mode to a ready mode, the bell crank can satisfactorily rotate about its axis NAA while the first and second pivots rotate about the arcs A1 and A2, without the leg binding movement of the bell crank and movement of the pivots. Optionally, in cases where an elongated slot, or other shaped larger slot is not included, it is possible that the leg might not be able to move without binding, which in turn can cause the fastener arm and cap arm to not appropriately and satisfactorily move the respective cap teeth and fastener teeth. The respective post and slot can be disposed on opposite ones of the bell crank and the leg, depending on the application.

Operation and use of the tool will now be described with reference to FIGS. 4-8. The use of the tool can be performed utilizing a method. The method can include one or more of the following steps: moving a pressure foot against a substrate to rotate a bell crank in a first direction about a pivot axis, the bell crank thereby moving a cap tooth along a cap guide and a fastener tooth along a fastener guide, and biasing a biasing element; actuating a driving unit with electricity from a power source; driving a fastener with the driving unit along a fastener driving path so that a first fastener pierces a first cap; and moving the pressure foot away from the substrate so that the bell crank rotates a second direction about the pivot axis under a bias force produced by the biasing element. Optionally, as the bell crank rotates in the second direction, the bell crank moves with a cap arm that causes a cap tooth to advance a second cap toward the fastener driving path, and the bell crank moves with a fastener arm that causes a fastener tooth to advance a second fastener toward the fastener driving path.

Figure 7:
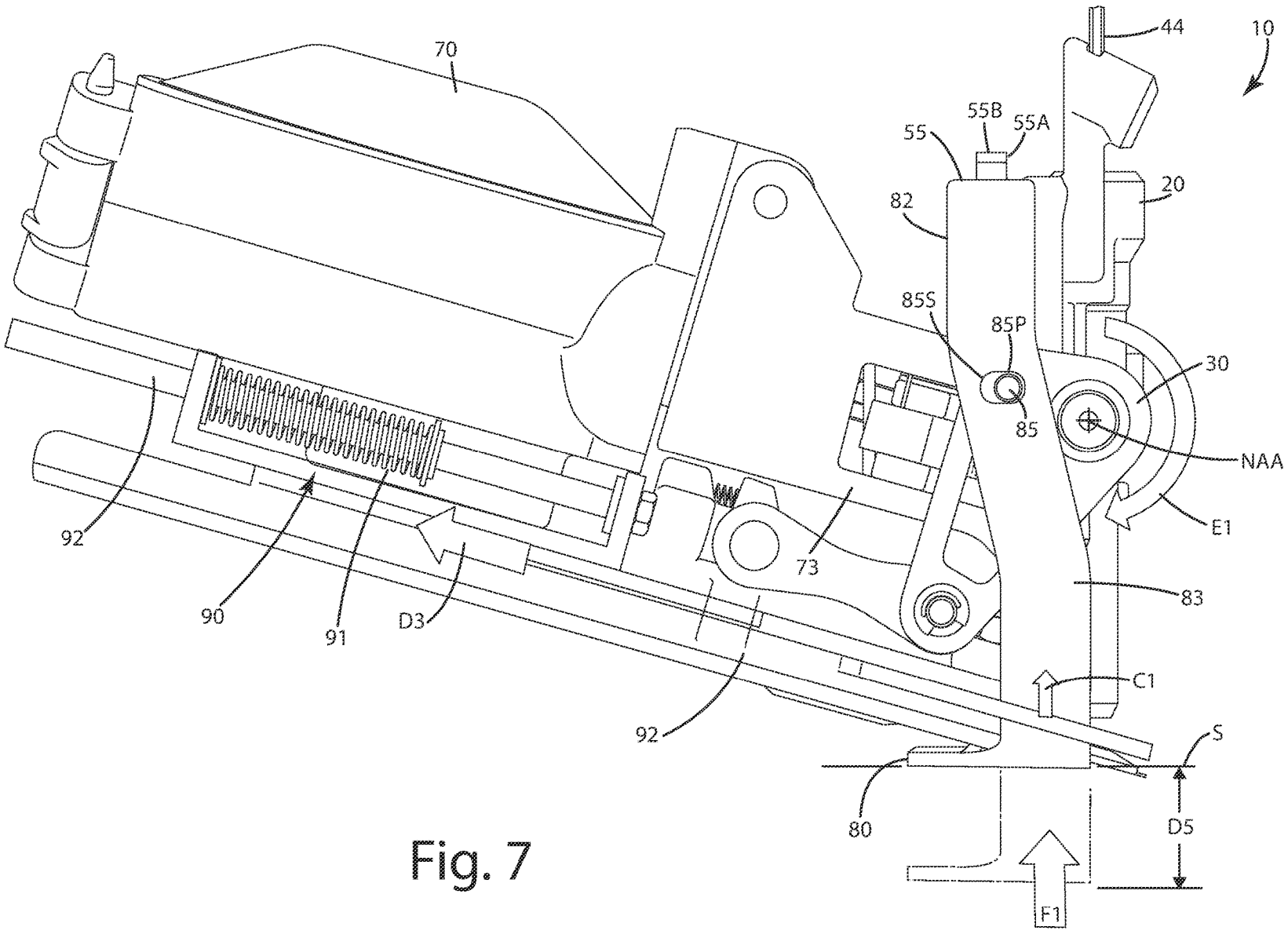
FIG. 7 is a side view of the tool being converted from the neutral mode to the ready mode, from which the tool can be converted to an advance mode.
Figure 8:
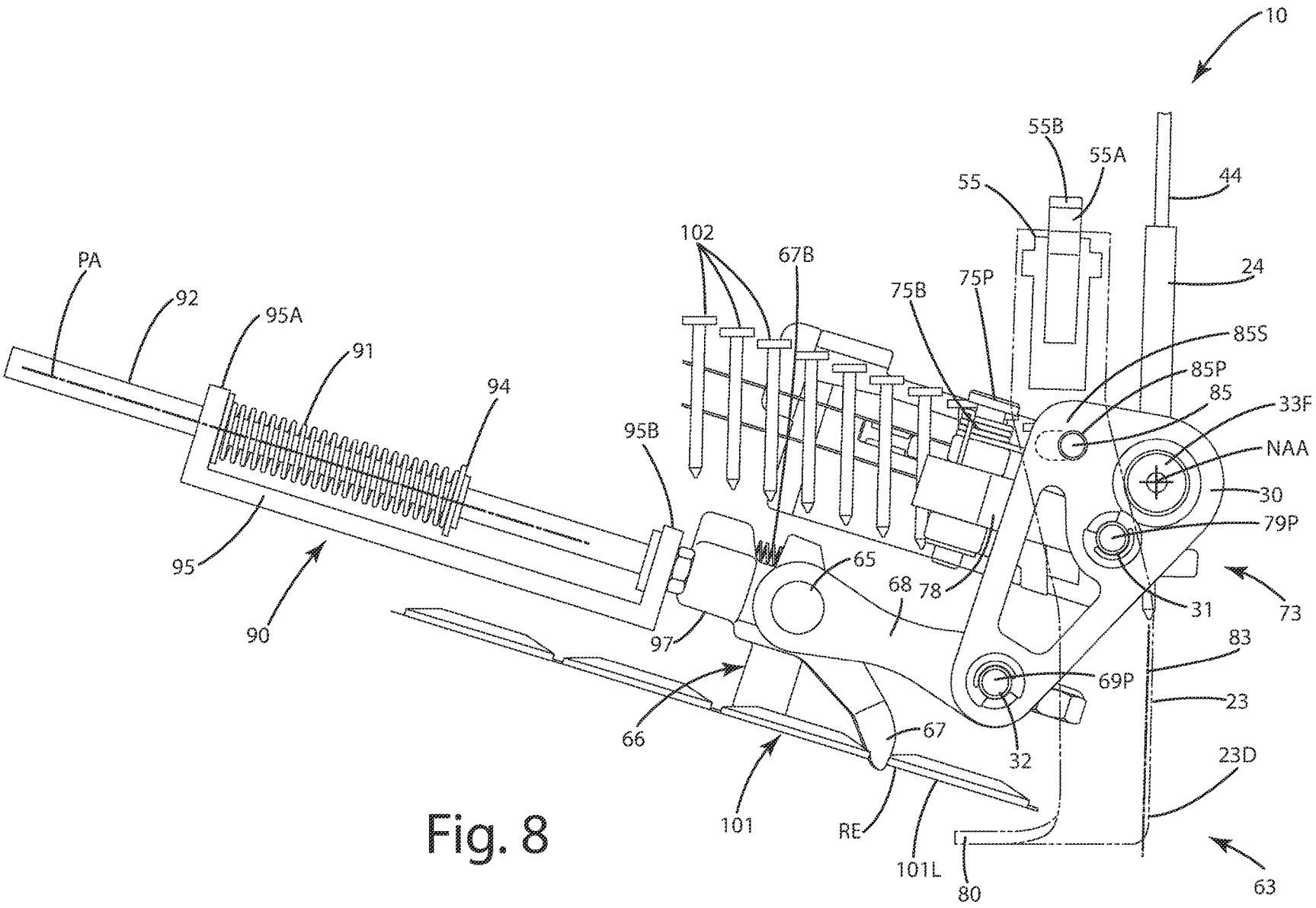
FIG. 8 is a side view of parts of the tool being converted from the neutral mode to the ready mode, from which the tool can be converted to the advance mode.
Figure 9:
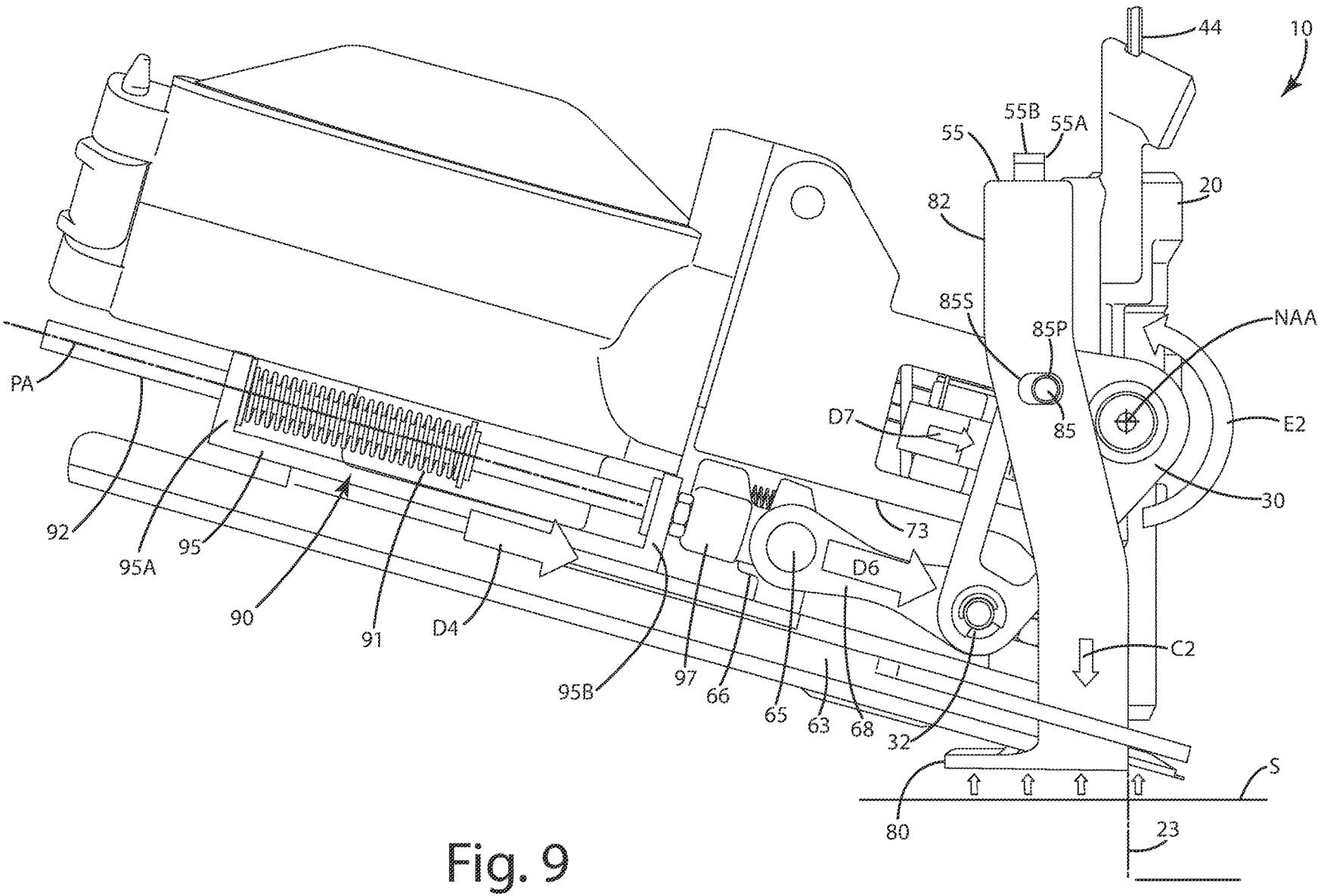
FIG. 9 is a side view of parts of the tool in the advance mode.

In use, the tool 10 can attain various configurations due to interaction of the pressure foot 80 with a substrate S and subsequent movement of the bell crank 30. These configurations can correspond to different modes of the bell crank. As an example, the bell crank 30 can be rotatably mounted to the nose assembly 20. Due to input from the pressure foot 80 and the associated leg 83, the bell crank can be operable in a neutral mode, shown generally in FIGS. 2-6, a ready mode as shown in FIGS. 7-8 and an advanced mode as shown in FIG. 9. In the neutral mode, the bell crank can be in a static condition, and is not moving anything in the tool. In the ready mode, the bell crank has been moved via interaction with the pressure foot, thereby storing energy in the biasing element 90. The biasing element is ready to move the bell crank, which will cause the bell crank to move various components, such as the fastener arm and the cap arm, and thereby move the associated fasteners 102 and caps 101 toward the fastener driving path and toward the discharge station 23. In the advance mode, the biasing element 90 is actually moving the bell crank, which in turn moves the cap arm and the fastener arm to move the respective cap teeth and fastener teeth to advance the next in line fastener and cap toward the fastener driving path 23 and the discharge station 23D.

Referring to FIGS. 1, 2 and 5, the pressure foot 80 is initially engaged against the substrate S. The fasteners 102 and caps 101 can be fully loaded in the tool 10. A user will push downward on the grip 46, with force F1. The force F1 is translated through the grip, the housing, the nose assembly and into the pressure foot. The force F1 is exerted against the substrate S. The substrate S pushes back with a corresponding force equal to F1. As a result, the pressure foot 80 moves upward in direction C1. The pressure foot 80, being joined with the leg 83, thus moves the leg 83 upward in direction C1. As a result, the pin 85P is engaged by the perimeter of the slot 85S defined by the leg 83. The post 85P, also being joined with the bell crank 30, urges the bell crank 30 to rotate in direction E1. As a result of this rotation, the first pivot 79P and the second pivot 69P travel on the arcs A1 and A2. These pivots are also attached respectively to the fastener arm 78 and the cap arm 68. As a result, the fastener arm moves in direction D1. The cap arm moves in direction D2. The corresponding fastener teeth 77 move relative to the fasteners 102, sliding over the fastener shafts as they move. The cap teeth 67 also move or slide over the tops of the caps 101.

During the application of the force F1 and the movement C1 of the leg and the rotation E1 of the bell crank and the corresponding movement of the arms, the cap arm 68 moves the feeder 66 and an associated connector 97. The connector 97 is joined with the piston 92, which can be in the form of an elongated rod. As the piston 92 of the biasing element 90 is moved in direction D3, the washer 94 pushes against the coil spring 91 of the biasing element. The coil spring is compressed under the force F1 as that force is applied. The washer 94 moves toward the end 95A of the bracket 95, compressing the coil spring 91 between the washer and that end 95A. This stores mechanical energy input by the force F1 being applied to the tool 10 via the biasing element, and in particular, the coil spring. The bell crank continues to rotate in direction E1 until the biasing element is fully or at least partially compressed. When the biasing element is so compressed, the bell crank 30 can cease rotation in direction E1.

At this point, the bell crank 30 and the tool 10 are configured in a ready mode. This ready mode is illustrated in FIG. 7, which also illustrates the aforementioned force F1 applied to the pressure foot 80, the previous movement in direction C1 of the leg 83, the previous rotation in direction E1 of the bell crank, and the previous movement in direction D3 of the piston 92 and compression of the biasing element 90. In this ready mode, the leg 83 and pressure foot 80 have moved upward a distance D5 relative to their position when the bell crank was in the neutral mode.

Due to the movement upward of the leg 83, the second end 82 of the leg can engage the contacts 55A and 55B and thus can actuate the safety switch 55. The safety switch, as mentioned above, is tied into a circuit with the electric motor 41 and power source 50. As a result, with the safety switch actuated, the tool can effectively sense that the pressure foot has been depressed and thus the tool 10 is ready to drive a fastener with the blade 44. At this point, a user can manually depress the trigger 45 of the tool 10. The electric motor 41 can spin the spool 42 and the striker tooth 43 can engage the blade 44. Of course, in some cases, the user may have already been pressing the trigger 45, before the pressure foot 80 was depressed. In this case, the electric motor 41 would already be spinning the spool 42, so when the safety switch 55 is actuated, the striker tooth 43 can automatically engage the blade 44.

When the blade 44 is engaged by the striker tooth or otherwise moved by the driving unit along at least a portion of the fastener driving path 23, the blade 44 engages a leading fastener 102L that is disposed in the fastener driving path 23. The blade will continue to push that fastener downward a preselected distance. The fastener 102L then can travel in the barrel of the nose assembly, being pushed by the blade 44. The fastener 102L can pierce a leading cap 101L that is disposed in the fastener driving path 23. The fastener and cap will be combined as a unit, and discharged through the discharge station 23D. The fastener will also penetrate and advance into the substrate S, pulling the cap downward against the surface of the substrate S. The substrate thus may be fastened directly to an underlying support. In general, the combined fastener and cap unit are joined with the substrate S, and optionally any underlying panel or other support below the substrate depending on the application.

With the combined leading fastener and cap dispensed from the tool, the blade retracts through the barrel and into the driving unit. An operator of the tool can observe that the combined leading fastener and cap have been dispensed from the tool 10. Upon perception of these components being applied to the substrate, the tool can be moved away from the substrate. When the tool is moved away from the substrate, the force F1 can be removed from the pressure foot 80.

This movement initiates the reconfiguration of the bell crank from the ready mode shown in FIGS. 7-8, to the initial stages of the advance mode shown in FIG. 9. The biasing element 90 configures the bell crank 30 from the ready mode to the advance mode when the pressure foot is moved away from the substrate S. The biasing element 90, which has stored mechanical energy therein due to the input of the force F1, begins to move the various components of the tool including the bell crank 30. Optionally, the fastener arm and tooth, and the cap arm and tooth are moved or prepared to be moved under only mechanical input through the input of the force F1. These components optionally are not moved due to input from the power source, or any associated motors or other non-mechanical input. In this way, with the cap feeder and/or fastener can be powered only via the mechanical input and/or a subsequent or stored biasing force. The electricity stored in the battery or power source can be conserved primarily for the fastener driving operation, optionally instead of advancing the caps and/or the fasteners. The biasing element 90 is configured to rotate the bell crank 30 about the pivot element axis NAA in direction E2, which is the opposite of the initial direction E1, when the bell crank was converted from a neutral mode to the ready mode. When the biasing element 90 moves the bell crank 30 in direction E2, the bell crank rotates about axis NAA. As shown in FIG. 9, the biasing element 90 can decompress. In particular, the spring 91 can push against the washer 94, which in turn pushes the piston 92 along the piston axis PA. The piston is joined with the connector 97 which can be joined pivotally to the cap arm 68 via the third pivot 65. This in turn moves the cap arm 68 in direction D6 which engages the second pivot 69P of the bell crank 30.

Rotation of the bell crank causes the components joined with the bell crank to move. For example, the bell crank 30 is joined with the leg 83 via the input 85 and in particular the post 85P. With the bell crank 30 rotating in direction E2, the post is driven downward in direction J1. This in turn pushes on the slot 85S in particular, its perimeter. The leg and attached foot 80 thus move downward in direction C2 toward a configuration similar to that in FIG. 4, before the force F1 was applied. The biasing element 90 and the spring 91 can extend as the pressure foot and leg are moving, which in turn pushes the cap arm toward the bell crank, thereby moving the bell crank in the second direction E2.

The movement of the leg 83 downward in direction C2 also disengages the second end 82 of the leg 83 from the contacts 55A and/or 55B. As a result, the switch 55 is disengaged such that the striker tooth 43 no longer is configured to engage the blade 44, optionally even if the trigger 45 is depressed by user. Thus, the motor 41 can continue to rotate the spool 42, but the blade 44 is not engaged to move along the driving fastener driving path 23. Again, this acts like a safety mechanism to prevent a user from inadvertently shooting a fastener from the tool.

Rotation of the bell crank also causes the fastener arm 78 to move in direction D7. This is due to the fastener arm 78 being joined with the bell crank 30 via the first pivot 79P. The fastener arm 78 thus moves linearly, pulling the teeth 77 (FIG. 6) forwardly toward the nose assembly 20 and in particular toward the fastener driving path 23. The bias element 75B keeps the teeth 77 engaged with a new leading fastener so that that new leading fastener is placed in the fastener driving path.

As noted above, when the bell crank 30 moves in direction E2, the cap arm 68 also simultaneously moves in direction D6. The cap arm 68 can be pushed by the connector 97 and the biasing element 90. The cap arm 68 also is joined with the bell crank 30 via the second pivot 69P The cap arm thus moves linearly, pulling the teeth 67 (FIG. 6) against the new leading cap 101L toward the nose assembly 20, in particular, toward the fastener driving path 23.

As the advance mode shown in FIG. 9 continues, the biasing element 90 continues to move the crank, rotating it about the axis NAA, in direction E2. Again as a result of this, the bell crank 30 moves the cap arm 68 and the attached cap tooth 67 to advance a second cap, also referred to as a new leading cap, toward the fastener driving path 23. And although the biasing element 90 technically engages the connector 97, which engages the cap arm 68 to move the cap arm 68, for purposes herein, the bell crank 30, by virtue of it being connected to the cap arm at the second pivot, is still considered to move, pull or otherwise reorient the cap arm and thus the cap tooth.

During the movement of the cap arm 68, the cap arm can move generally linearly in direction D6, but can rotate slightly depending on the configuration of the bell crank and its attachment to the cap arm at the second pivot 69P. The cap teeth 67 can engage the new leading cap or second cap. This, in turn, pulls the cap strip including the multiple caps 101 joined edge to edge toward the fastener driving path 23. As this occurs, the cap strip can be pulled out from the cap magazine 60, which can result in an unfurling of a spool of the caps, and subsequent additional caps exiting from the cap magazine.

The cap arm and cap teeth are configured so that upon extension of the biasing element 90, the cap teeth present the second cap or new leading cap in a position aligned with the fastener driving path 23, generally in the discharge station 23D. A portion of the new leading cap can be at least partially supported by the cap guide 63 in a portion of cap track 65.

The bell crank 30 also can move the fastener arm 78 in direction D7 in the advance mode. This movement can cause the fastener arm to move linearly in direction D7, but again the fastener arm can rotate slightly depending on the configuration of bell crank and its attachment to the fastener arm at the first pivot 79P. The movement of the fastener arm in direction D7 also moves the fastener teeth 77 toward the fastener driving path 23. The bias element 75B biases and rotates the pivot pin 75P about the axis 75A such that the teeth 77 adequately engage the fasteners, thus advancing a second fastener, also referred to as a new leading fastener, toward the fastener driving path 23. The teeth 77 can be configured so that the new leading fastener is disposed in the barrel 24, below the blade 44, in the nose assembly along the fastener driving path 23.

Optionally, extension of the spring 91 and the biasing element 90 in general can cease when the washer 94 engages the arm 95B of the bracket 95. This amount of extension can correspond to the bell crank 30 being rotated back to its initial position and restored to the neutral mode, after having completed the advance mode. When the neutral mode is achieved, the cap teeth have advanced the new leading cap sufficiently into the fastener driving path 23, and likewise the fastener teeth 77 have advanced the new leading fastener sufficiently into the fastener driving path 23. The process above can be repeated to disperse and apply multiple caps and fastener units into the substrate.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

What is claimed is:

1. A tool for discharging a fastener through a cap, the tool comprising:

a driving unit including a blade and a connector, the blade moveable during a driving operation along a fastener driving path;

a nose assembly aligned with the driving unit, the blade selectively moveable in the nose assembly, the nose assembly including a nose assembly pivot element;

a fastener magazine joined with at least one of the housing and the nose assembly, the fastener magazine containing a plurality of fasteners aligned along a fastener guide leading toward the fastener driving path so that a leading fastener is disposable in the fastener driving path below the blade;

a cap magazine disposed adjacent the nose assembly, the cap magazine containing a cap strip including a plurality of caps joined edge-to-edge and aligned along a cap guide leading toward the fastener driving path so that a leading cap is disposable below the leading fastener;

a bell crank rotatably mounted to the nose assembly pivot element, the bell crank extending downward adjacent the fastener guide, the bell crank operable in a neutral mode, a ready mode, and an advance mode, the bell crank urged from the neutral mode to the ready mode by a biasing element;

a fastener arm rotatably joined with the bell crank at a first pivot, the fastener arm joined with a fastener tooth configured to engage at least one of the plurality of fasteners on the fastener guide;

a cap arm rotatably joined with the bell crank at a second pivot located below the first pivot, the cap arm joined with a cap tooth configured to engage at least one of the plurality of caps on the cap guide; and a pressure foot including a leg extending upward adjacent the bell crank, the leg moveably joined with the bell crank at an input, wherein the pressure foot is configured to engage a substrate thereby transferring movement through the leg to the bell crank through the input, such that the bell crank is urged from the neutral mode to the ready mode against a force of the biasing element, wherein the biasing element configures the bell crank from the ready mode to the advance mode when the pressure foot is moved away from the substrate such that in the advance mode, the fastener tooth engages the plurality of fasteners so that the leading fastener is moved toward the fastener driving path, and such that in the advance mode, the cap tooth engages the plurality of caps so that the leading cap is moved toward the fastener driving path.

2. The tool of claim 1 comprising:

a power source joined with the connector to selectively power the driving unit and move the blade during a driving operation along a fastener driving path;

wherein the power source is configured to power the driving unit and move the blade during a driving operation to drive the leading fastener through the leading cap and into the substrate.

3. The tool of claim 1, wherein the input includes a pin that rides in an elongated slot when the bell crank moves.

4. The tool of claim 1, wherein the cap guide extends toward the fastener driving path along a cap path, wherein the biasing element is a spring joined with a piston that extends toward the bell crank along a piston path.

5. The tool of claim 1, wherein the biasing element is a coil spring disposed around at least a portion of the nose assembly pivot element.

6. The tool of claim 1, wherein the cap tooth is configured to slide over individual ones of the plurality of caps.

7. The tool of claim 1, comprising:

a safety switch proximal at least one of the leg and the bell crank, wherein the driving unit includes an electric motor, wherein the safety switch is electrically coupled to the electric motor so that the blade only moves when the safety switch is engaged by at least one of the leg and the bell crank.

8. The tool of claim 1, comprising:

a battery joined with the housing and located above the fastener guide and over the cap magazine.

9. The tool of claim 1, wherein the leg is substantially parallel to the bell crank, wherein the fastener guide is substantially parallel to the cap guide, wherein the fastener driving path is substantially parallel to the leg, and transverse to the cap guide and the fastener guide.

10. The tool of claim 1, wherein the leg is configured to move substantially linearly beside the bell crank while the bell crank rotates about the nose assembly pivot element.

11. A tool for discharging a fastener through a cap, the tool comprising:

a nose assembly joined with a driving unit;

a fastener guide leading toward a fastener driving path in the nose assembly, the fastener guide supporting a plurality of fasteners;

a cap guide leading toward the fastener driving path, the cap guide supporting a plurality of caps joined edge-to-edge, the cap guide extending toward the nose assembly;

a fastener arm moveably mounted adjacent the nose assembly, the fastener arm configured to move at least one of the plurality of fasteners on the fastener guide;

a cap arm moveably mounted adjacent the nose assembly distal from the fastener arm, the cap arm configured to move at least one of the plurality of caps on the cap guide;

a pressure foot including a leg operably coupled to at least one of the fastener arm and the cap arm through an input;

wherein the pressure foot is configured to engage a substrate thereby transferring movement through the leg and the input, such that the fastener arm and cap arm are urged to a ready mode against a biasing force, wherein the biasing force moves the fastener arm in an advance mode so at least one fastener moves toward the fastener driving path, wherein the biasing force moves the cap arm in the advance mode, so that at least one cap moves toward the fastener driving path, wherein the driving unit is operable to drive the at least one fastener so that the at least one fastener extends through the at least one cap and advances into the substrate, thereby joining a combined fastener and cap with the substrate.

12. The tool of claim 11 comprising:

a battery electrically coupled to the driving unit such that the battery powers the driving unit to move a blade along the fastener driving path, wherein the battery imparts no energy to move the fastener arm and the cap arm in the advance mode.

13. The tool of claim 11 comprising:

wherein the driving unit is operable to move the blade along the fastener driving path under a first force input, wherein the fastener arm and cap arm are moved under only a mechanical second force input different from the first force input.

14. The tool of claim 11, wherein the input includes a pivot post that extends from a first plate through an elongated slot defined by a second plate.

15. The tool of claim 11, comprising:

a bell crank mounted adjacent the nose assembly and joined with the leg, wherein the leg is extended upward and transversely relative to the fastener arm and the cap arm.

16. The tool of claim 11 comprising:

a grip including a first end proximal the driving unit and a second end distal from the driving unit;

a rechargeable battery removably and replacably joined with the second end of the grip, wherein the driving unit is electrically coupled to the rechargeable battery, wherein the driving unit is powered by the rechargeable battery to move a blade.

17. A method of using a tool to install a fastener and a cap, the method comprising:

pressing a pressure foot against a substrate to move a cap tooth along a cap guide and a fastener tooth along a fastener guide, and biasing a biasing element;

powering a driving unit with electricity from a power source;

driving a fastener with the driving unit along a fastener driving path so that a first fastener pierces a first cap;

moving the pressure foot away from the substrate so as to configure a bell crank from a ready mode to an advance mode, in which said advance mode the bell crank moves a cap tooth to advance a second cap toward the fastener driving path, and in which said advance mode the bell crank moves a fastener tooth to advance a second fastener toward the fastener driving path, with a bias force produced by the biasing element.

18. The method of claim 17, comprising:

engaging a safety switch before said actuating step to allow the driving step to proceed; and engaging a bell crank with the biasing element to rotate the bell crank, which is operatively joined with the cap tooth and the fastener tooth.

19. The method of claim 17, wherein the power source is a rechargeable battery, wherein a safety switch is engaged before said actuating step to allow the driving step to proceed, wherein the biasing element is an elongated coil spring joined with a cap arm joined with the cap tooth, wherein the coil spring is compressed when during the pressing step, wherein the coil spring extends during the moving the pressure foot step to push the cap arm.

20. The method of claim 17:

wherein the power source is a rechargeable battery, wherein no electricity from the rechargeable battery is utilized to move the first cap, the second cap, the first fastener and the second fastener.

* * * * *